US005189817A

United States Patent [19]

Schroeder

[11] Patent Number: 5,189,817

[45] Date of Patent: Mar. 2, 1993

[54] CRUMBER MECHANISM FOR A TRENCHER MACHINE

[75] Inventor: Philip W. Schroeder, Derby, Kans.

[73] Assignee: Case Corporation, Racine, Wis.

[21] Appl. No.: 919,290

[22] Filed: Jul. 24, 1992

[51] Int. Cl.[5] ..... E02F 5/06

[52] U.S. Cl. ..... 37/86; 37/83

[58] Field of Search ..... 37/80 R, 83, 86, 86 A, 37/86.5, 87, 88, 89, 90, 191 A, 191 R

[56] References Cited

U.S. PATENT DOCUMENTS

| | | | |
|---|---|---|---|
| 3,932,951 | 1/1976 | Scott et al. | 37/86 |
| 4,043,135 | 8/1977 | Hoes et al. | 37/86 X |
| 4,827,636 | 5/1989 | Emming | 37/86 |

FOREIGN PATENT DOCUMENTS

| | | | |
|---|---|---|---|
| 254794 | 9/1966 | Austria | 37/86 |
| 405950 | 1/1991 | European Pat. Off. | 37/83 |
| 133692 | 8/1958 | U.S.S.R. | 37/86 |
| 160112 | 4/1964 | U.S.S.R. | 37/86 |
| 224380 | 6/1968 | U.S.S.R. | 37/86 |
| 235650 | 5/1969 | U.S.S.R. | 37/86 |
| 524887 | 11/1976 | U.S.S.R. | 37/86 |
| 1244245 | 7/1986 | U.S.S.R. | 37/80 R |

*Primary Examiner*—Randolph A. Reese
*Assistant Examiner*—Arlen L. Olsen
*Attorney, Agent, or Firm*—Dressler, Goldsmith, Shore, Sutker & Milnamow, Ltd.

[57] ABSTRACT

A crumber mechanism including a crumber shoe mounted on a support boom for powered movement between operative and non-operative positions. A fluid powered motor coacts with a linkage mechanism to move the shoe between positions in response to operation of the motor. An automatic locking device releasably holds the crumber shoe in a working position. The automatic locking device includes a slidable lock which moves into locking coaction with a locking channel defined by the shoe in response to extension of the hydraulic motor.

7 Claims, 3 Drawing Sheets

CRUMBER MECHANISM FOR A TRENCHER MACHINE

FIELD OF THE INVENTION

The present invention generally relates to trencher machines and, more particularly, to a crumber mechanism which is selectively movable between working and non-working positions.

A conventional trencher machine includes an elongated boom which is connected to a frame of the trencher machine for vertical pivotal movement. A digging chain and tooth assembly is supported by the boom for orbital movement thereabout. A crumber mechanism is typically arranged in combination with the chain and tooth assembly of the trencher machine.

A crumber mechanism typically includes a crumber shoe that is attached toward an outer end of the trencher boom. The shoe extends downwardly from the boom to the floor of the trench or excavation and is so designed to shove or propel loose material or spoils on the floor of the trench forwardly so that it is picked up by the rotating chain and tooth assembly and removed from the trench so as to maintain the floor of the trench comparatively clean.

It is also known in the art to swingably mount the crumber shoe to the outer end of the trencher boom for movement in a generally vertical plane between working and non-working positions. As will be appreciated, the ability to move the crumber shoe to a non-working position allows the digging chain and tooth assembly to be operated in close proximity to a vertical wall such as a basement wall or foundation, thus reducing to a minimum the manual labor required in such excavation procedures. The ability to move the crumber shoe to a non-working position further enhances the maneuverability of the trencher machine.

Various mechanisms have been utilized in the past for releasably maintaining the crumber shoe in an operative position. Until recently, most of such devices generally necessitated a considerable amount of manual operations to effect proper positioning of the crumber shoe. Recently, the crumber shoe has been positioned between operative and non-operative positions under the influence of a fluid powered motor such as a double-acting hydraulic cylinder. Advantageously, actuation of the motor provides rapid and selective movement of the crumber shoe as controlled by the operator of the machine without requiring the operator to leave the work station and in a manner greatly reducing the labor and time involved in properly positioning the crumber shoe between working and non-working positions.

None of these latter crumber arrangements, however, have been found to be completely satisfactory. In rocky or other adverse trenching conditions, and as the trencher machine advances, the crumber shoe impacts with and often becomes lodged on obstacles, i.e., rocks, tree roots, and etc. The extended distance separating the pivotal attachment of the shoe to the boom and the distal end of the shoe furthermore aggravates the problem of severe loading or strains being imparted to the hydraulic motor used to maintain and hold the crumber shoe in its operative position. Such loading and straining on the hydraulic motor can cause damage to hydraulic seals and other working components of the cylinder and, ultimately, may require repair or replacement of the hydraulic motor. As will be appreciated, such repair and replacement involves costly downtime for the trencher machine.

Thus, there is a need and a desire for a crumber mechanism having the ability to retain the crumber shoe in a working position while being capable of withstanding the severe strains and loading placed thereon during the digging operation while also being capable of moving the crumber shoe to a non-working position with a minimum amount of operator involvement and effort.

SUMMARY OF THE INVENTION

In view of the above, and in accordance with the present invention, there is provided a crumber mechanism including a crumber shoe which is mounted on a support boom and is powered for movement between working and non-working positions. A fluid powered motor coacts with a linkage mechanism to move the shoe between positions in response to operation of the motor. A salient feature of the present invention concerns an automatic locking device for releasably holding the crumber shoe in its working position. The automatic locking device includes a lock carried by the linkage mechanism and which automatically moves in an elongated slot defined by the shoe in response to operation of the motor. The lock is movable into locking coaction with a slotted groove or channel defined by the support beam when the shoe is moved into its working position thereby relieving the motor of hydraulic stresses during a tensioning operation and therefore eliminating the need for additional bracing of the shoe. Moreover, the lock is automatically released from the locking groove or channel upon movement of the shoe toward its non-working position.

In a preferred form of the invention, the linkage mechanism is configured as a toggle linkage assembly including a push/pull link connected between the hydraulic motor and the crumber shoe and a guide link connected between the support boom and the hydraulic motor. The links are connected to each other and to the hydraulic motor at a common joinder point or location.

In a most preferred form of the invention, the crumber shoe includes a pair of laterally spaced side plates which define the elongated slot in which the lock moves or slides. Similarly, the support boom includes a pair of laterally spaced plates which define the locking channel. When the shoe is in its non-operative position, the slot defined thereby extends at an acute angle relative to the directional force developed by the hydraulic motor. When the shoe is in its operative or working position, however, the elongated slot and the lock receiving channel are aligned relative to each other thereby allowing the lock to slide into the channel to establish a locking relationship between the shoe and the support boom. In its working position, the slot in the shoe extends generally parallel to the longitudinal axis of the push/pull link thereby facilitating release of the lock from the locking channel upon retraction of the hydraulic motor. As will be understood, the locking channel is adapted to snugly receive the slidable lock between opposed locking surfaces defined by the support boom.

The advantage of the present invention being that the fluid powered motor rapidly and selectively positions the crumber shoe into and out of active positions with minimum operator involvement. Another advantage of the present invention is the provision of a locking device which is operative to automatically lock the crumber shoe in operative position and to automatically disengage the locking mechanism upon movement of the crumber shoe toward an inactive position. The ability to lock the shoe in position eliminates the severe loading of the hydraulic motor and thus prolongs the usefulness of the crumbing mechanism. The crumber mechanism of the present invention is comparatively uncomplicated in design and may be readily added to existing trencher machines or may be easily embodied in the design of such new machines.

Numerous other features and advantages of the present invention will become readily apparent from the following detailed description, the accompanying drawings, and the appended claims.

DETAILED DESCRIPTION OF THE INVENTION

Figure 1:
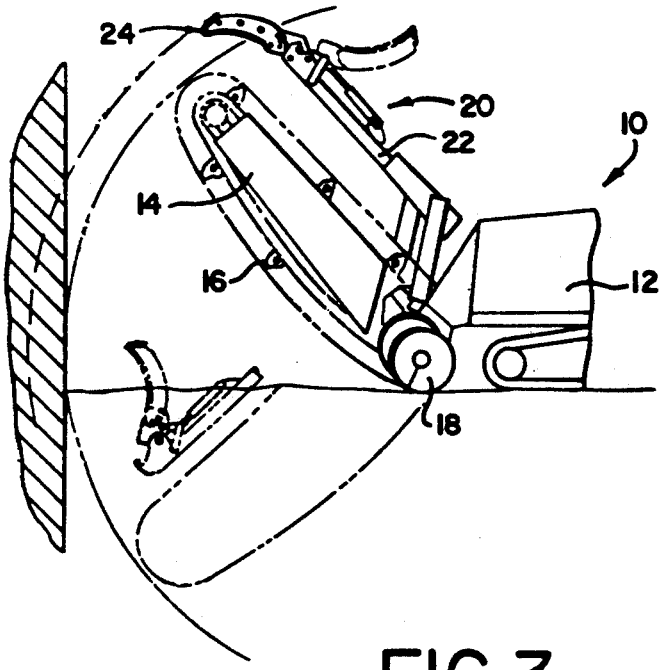
FIG. 1 is a side elevational view of a trencher machine embodying the crumber mechanism of the present invention.

While the present invention is susceptible of embodiment in various forms, there is shown in the drawings a presently preferred embodiment hereinafter described, with the understanding that the present disclosure is to be considered as an exemplification of the invention and is not intended to limit the invention to the specific embodiment illustrated.

Referring now to the drawings, wherein like reference numerals refer to like parts throughout the several views, there is shown in FIG. 1 a trencher machine 10 of a well known type and which includes a frame 12 supported for movement over ground. The trencher machine further includes an elongated digging boom or support 14 pivotally mounted on the frame 12 and arranged to be raised and lowered relative to the frame of the trencher through conventional means selectively controlled by the operator. As is conventional, a digging chain and tooth assembly 16 is mounted for orbital movement about the boom 14 for digging in the ground. The material excavated by the chain and tooth assembly 16 is carried upwardly toward the frame 12 and thence to the sides of the trencher machine by an auger 18.

During the trenching or excavating operation, a certain amount of excavated material remains entrapped in the chain and tooth assembly 16 until the chain and tooth assembly begins its downward movement. This material, together with that which drops from the assembly 16, falls to the bottom of the excavated trench. Likewise, a certain amount of material is carried to the bottom of the trench by the movement of the chain and tooth assembly 16 therethrough. A crumber mechanism, generally designated by reference numeral 20, is provided on the trencher machine to act as a hopper which drags and directs material forwardly so that such spoils will be picked up and removed from the trench by the moving chain and tooth assembly thus producing a clean trench.

Figure 2:
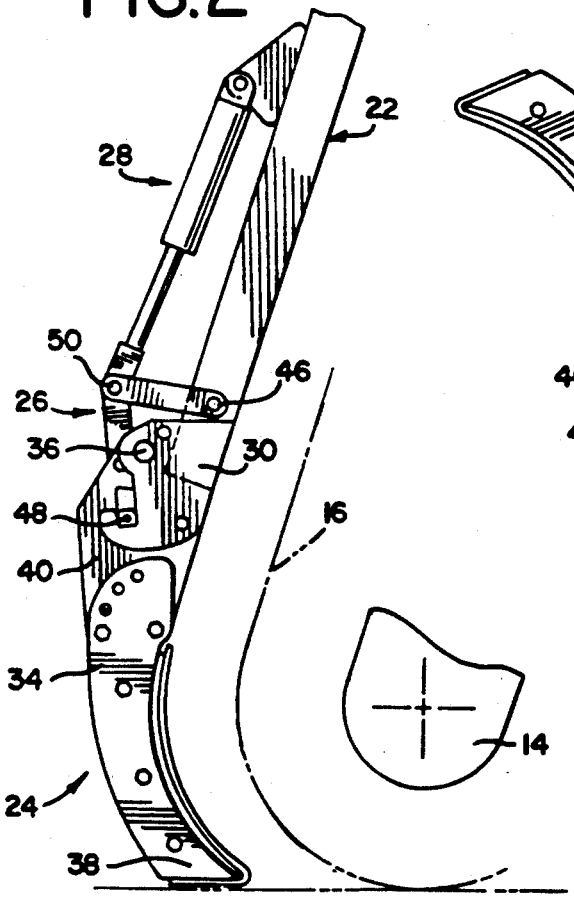
FIG. 2 is a side elevational view of the crumber mechanism in its work position.
Figure 3:
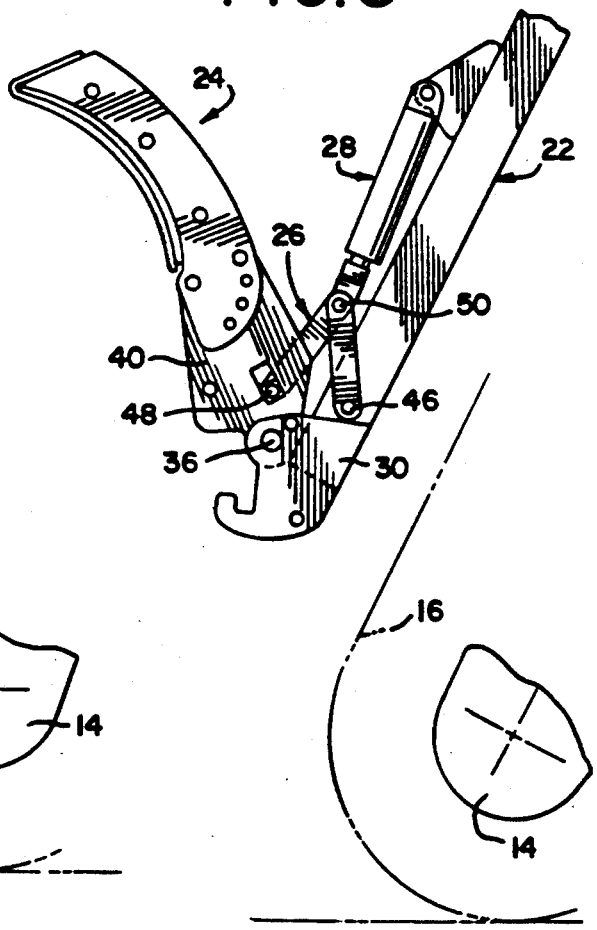
FIG. 3 is a side elevational view of the crumber mechanism in an inoperative or transport position.

The crumber mechanism 20 is provided closely adjacent to the chain and tooth assembly 16. As shown in FIGS. 2 and 3, the crumber mechanism preferably includes a support boom 22, a crumber shoe 24, a linkage mechanism 26, and a hydraulic fluid motor 28.

As shown, the support boom 22 is comprised of an elongated generally box-like structure which is attached to and carried for movement with the digging boom 14. At its distal end, the support boom 22 includes spaced side plates 30 fixedly attached thereto and which provide for pivotal mounting of the crumber shoe 24 to the outer end of the support boom 22.

The crumber shoe 24 includes an elongated generally arcuate shaped in side elevation box-like structure 34 which is pivotally mounted as by means of a removable bolt or shaft element 36 to the outer end of boom 22. At its distal end, crumber shoe 24 has a ground engaging portion 38. The opposite end of shoe 24 includes spaced side plates 40 which provide for the pivotal mounting of the shoe 24 to the outer end of the boom 22.

Figure 4:
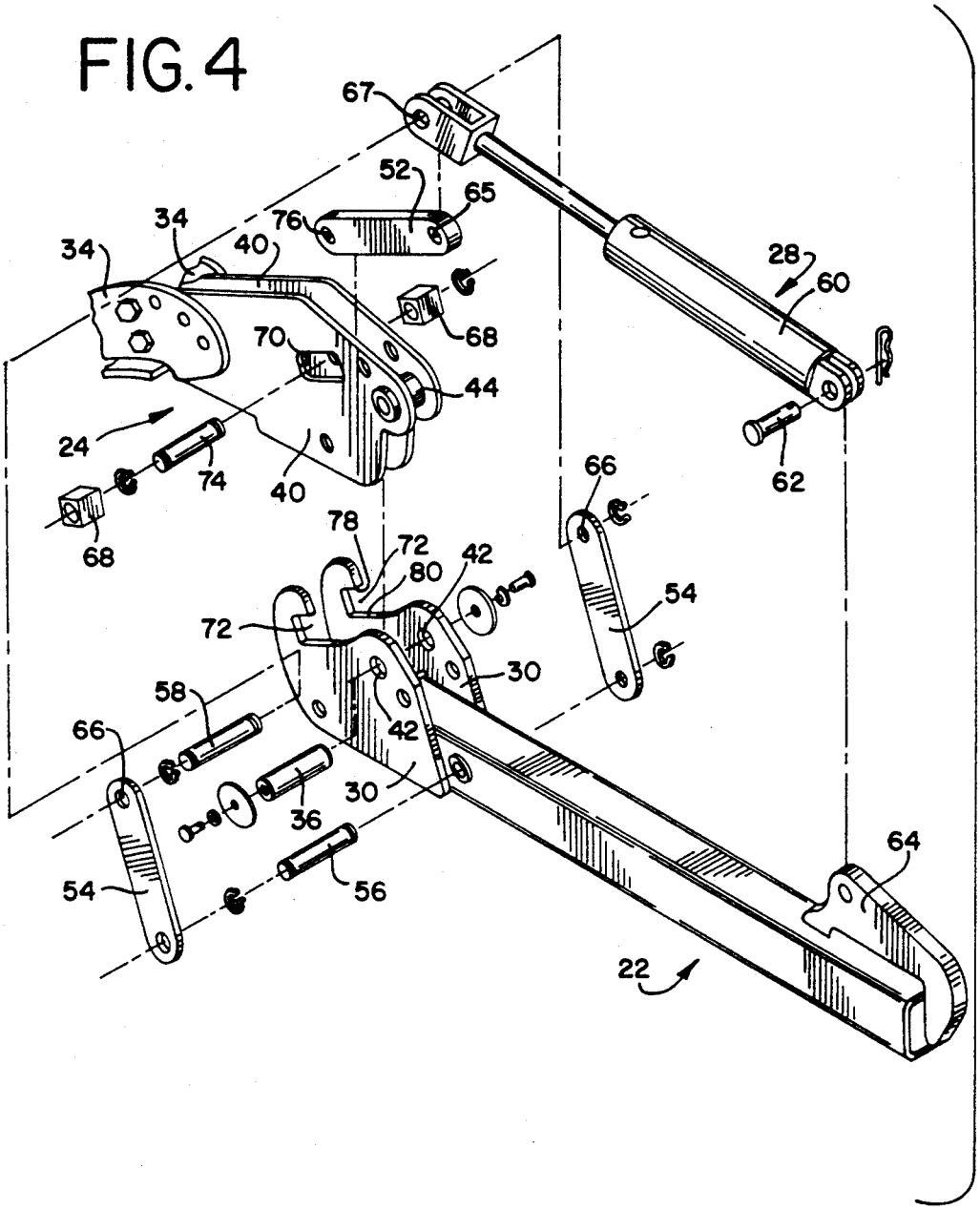
FIG. 4 is an exploded perspective view of a portion of the crumber mechanism.

In the illustrated embodiment, and as shown in FIG. 4, the side plate portions 40 of shoe 24 are received intermediate the transversely spaced side plate portions 30 of boom 22. Transversely aligned openings 42 on the side plate portions 30 of boom 22 accommodate the bolt or shaft 36 for endwise passage therethrough. The bolt or shaft 36 likewise passes endwise through a cylindrical sleeve 44 on shoe 24 to facilitate pivotal movement of the shoe 24.

Returning to FIGS. 2 and 3, the linkage mechanism 26 is pivotally connected to the boom 22 as at 46, and to the crumber shoe 24 as at 48, for swinging the crumber shoe about its pivotal connection 36 to the boom 22 and thus moving the shoe 24 between its working position (FIG. 2) and its non-working position (FIG. 3). The linkage mechanism 26 is preferably configured as a toggle linkage mechanism which is articulately joined, as at 50, to the hydraulic motor 28.

Turning again to FIG. 4, linkage mechanism 26 comprises a push/pull link 52 and guide links 54. The guide links 54 are rotatably connected as aforementioned at 46 by means of a transverse shaft element 56 to the outer end of the boom 22. At their other end, guide links 54 are commonly connected as aforementioned to the push/pull link 52 and to the hydraulic motor 28 as by a shaft or bolt element 58.

The hydraulic motor 28 includes a hydraulically actuated extendable/retractable double-acting cylinder 60. Cylinder 60 is connected to boom 22 such that its extendable/retractable path of movement generally parallels the longitudinal axis of boom 22. The cylinder 60 is articulately connected at one end as by means of a pin 62 to lug 64 extending from broom 22. The opposite end of cylinder 60 is pivotally connected to the linkage 26 at connection 50 as by means of bolt or shaft element 58 which passes through transversely aligned apertures 65, 66, and 67 defined by links 52, 54 and the extendable end of cylinder 60, respectively. It will be seen that the linkage 26 and hydraulic motor 28 are centrally arranged at the outer end of the boom to advantageously apply stresses resulting from its operation to the boom.

In accordance with the present invention, an automatic lock mechanism is provided for releasably and automatically locking the crumber shoe 24 in a working position and relative to the support boom 22 in response to extension of the hydraulic motor 28. In the illustrated embodiment, the automatic locking mechanism includes a lock 68 carried by the push/pull link 52 of linkage 26 and which automatically moves in an elongated slot 70 defined by plate portions 40 of shoe 24 in response to operation of motor 28. Lock 68 is movable into locking coaction with a slotted groove or locking channel 72 defined by the plate portions 30 of the boom 22 when the shoe 24 is moved into a working position.

Figures 5, 6, 7:
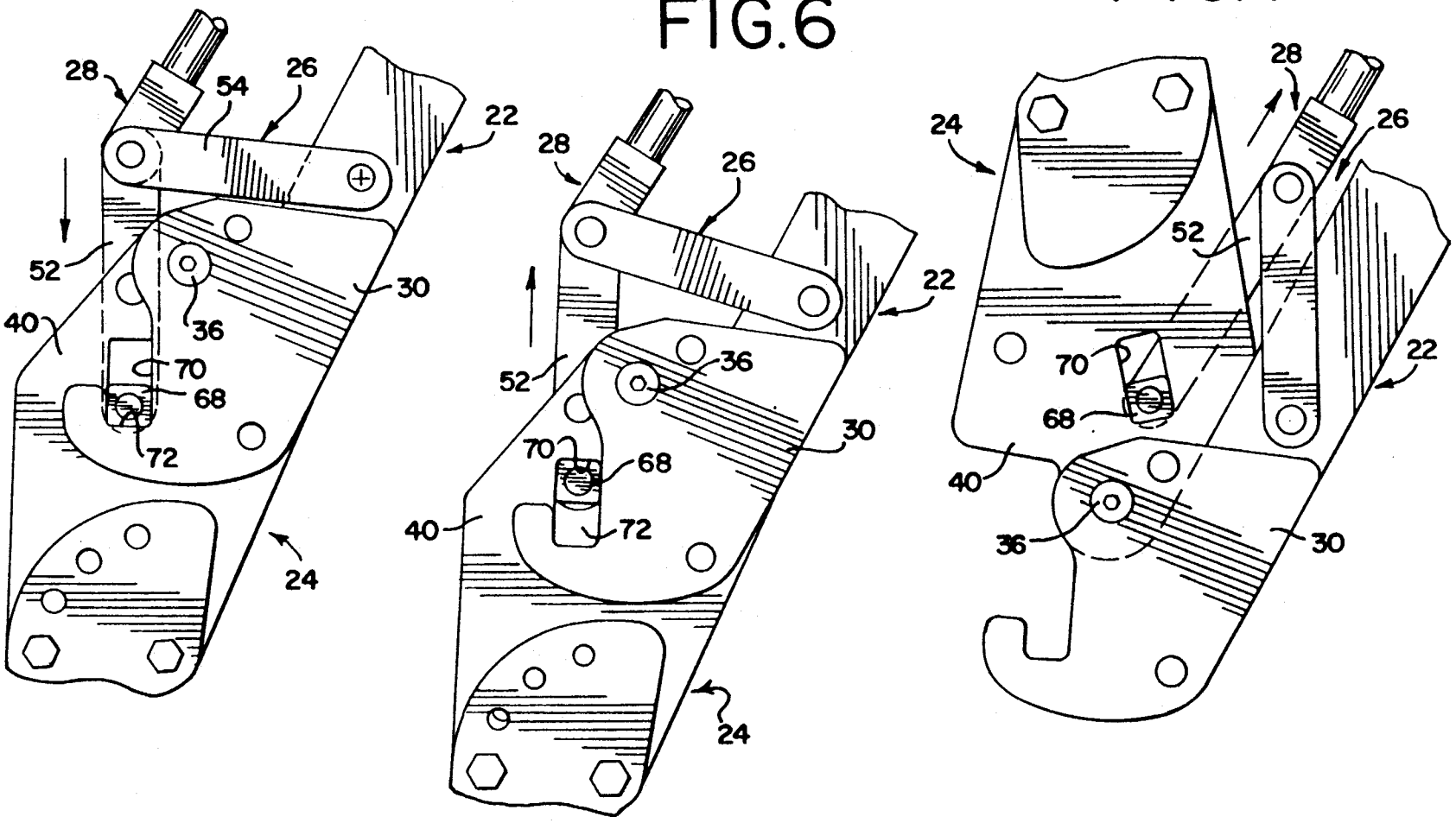
FIG. 5 is a fragmentary, enlarged side elevational view of a portion of the crumber mechanism with the crumber shoe in an operative position and illustrating in greater detail a locking assembly for automatically locking a crumber shoe in an operative position.
FIG. 6 is a fragmentary, enlarged, side elevational view similar to FIG. 5 with the crumber shoe in a working position and illustrating the locking assembly in a released condition.
FIG. 7 is a fragmentary, enlarged, side elevational view similar to FIGS. 5 and 6, but illustrating the crumber shoe in an inactive position and the locking assembly in a released position.

Turning to FIG. 5, when the crumber shoe 24 is moved into its working or operative position, the elongated slot 70 is aligned with the locking channel 72 thus allowing lock 68 to readily slide into locking coaction with the channel 72. Moreover, with shoe 24 in a working position, the elongated slot or guideway 70 for lock 68 extends substantially parallel to the longitudinal axis of the push/pull link 52 thereby providing a mechanical advantage for the motor 28 in holding the lock 68 in position.

As will be appreciated from an understanding of the present invention, when the shoe 24 is to be moved to a non-working position, lock 68 automatically moves to an opposite end of the elongated slot or guideway 70 in response to retraction of motor 28 as shown in FIG. 6. Moreover, as will be appreciated, the slot 70 is lengthwise sized such that the lock 68 is fully released from the locking channel 72 when it reaches the opposite end of the slot 70. Having the slot or guideway 70 extend substantially parallel to the longitudinal axis or direction of movement of the push/pull link 52 of mechanism 28 facilitates release of the lock 68 from the channel 72 upon retraction of motor 28. After the lock 68 reaches the opposite end of slot 70, continued retraction of motor 28 causes the shoe 24 to pivot about joint 36 toward a non-operative position.

When shoe 24 is in a non-operative position, as shown in FIG. 7, the elongated slot or guideway 70 for the lock 68 extends at an acute angle relative to the push-/pull link 52 of linkage 26. Therefore, upon extension of motor 28, lock 68 acts against the guideway 70 and forcibly pivots the shoe 24 about its pivotal connection 36 to the boom 22.

In the illustrated embodiment, lock 68 has a generally rectangular configuration in side elevation. As shown in FIG. 4, lock 68 is carried by a pin or shaft 74 which passes endwise through an aperture 76 defined by push-/pull link 52 to act as the aforementioned connection 48 of linkage 26 to shoe 24. The outer surfaces extending about lock 68 slide between and transversely extend beyond guide surfaces defined by the parameters of slot 70. As should be appreciated, locking surfaces 78 and 80 defined by the locking channel 72 are dimensioned to snugly receive the lock 68 therebetween.

The present invention provides for an improved power actuated crumber mechanism which may be rapidly and selectively swung between an operative and nonoperative positions without requiring substantial effort on the part of the operator. Aligning the hydraulic motor 28 and the linkage mechanism 26 relative to the boom minimizes stresses applied to the boom through powered actuation of the crumber shoe. Moreover, the locking mechanism is automatically actuated to lock the crumber shoe in its working position. Thus, the loads and stresses which naturally result from the shoe 24 impacting with or becoming lodged on obstacles within the trench are advantageously transferred to the stronger boom structure 22 through the locking coaction established between lock 68 and the locking channel 72. Thus, the hydraulic motor 28 is no longer required to absorb such stresses and loads thereby prolonging the useful life thereof.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

WHAT IS CLAIMED IS:

1. A crumber mechanism for a trencher machine having a digging chain assembly mounted for orbital movement about an elongated boom, said crumber mechanism comprising:

a support boom attached to said elongated boom;

a crumber shoe pivotally mounted on said support boom for swinging movement in a generally vertical plane of travel between working and non-working positions;

a fluid powered motor operatively coupled to said support boom and said shoe;

a linkage mechanism mounted on said support boom and coacting with said motor to move said shoe between positions in response to operation of said motor, said linkage mechanism connecting said motor and said shoe; and means for releasably locking said crumber shoe in a working position relative to said support boom, said locking means including a lock carried by said linkage mechanism and a slotted groove defined by said support boom, an elongated slot defined by said shoe and in response to operation of said motor, said lock being movable into locking coaction with said slotted groove when said shoe is moved into its working position thereby relieving the motor of hydraulic stresses during a trenching operation and which is automatically released from said groove upon movement of said shoe toward said non-working position.

2. The crumber mechanism according to claim 1 wherein said linkage mechanism further includes a guide link connected to a push/pull link of said linkage mechanism and to said support boom.

3. The crumber according to claim 1 wherein said elongated slot is defined by a pair of laterally spaced side plates connected to said crumber shoe, with said slot extending generally parallel to the longitudinal axis of a push/pull link of said linkage mechanism when in its working position and which extends at an acute angle relative to the longitudinal axis of said push/pull link when said shoe is in its non-working position.

4. A crumber mechanism for a trencher machine having a digging chain assembly arranged for movement about a generally horizontal elongated boom, said crumber mechanism comprising:

a support boom carried by and extending generally parallel to said elongated boom;

a crumber shoe pivotally mounted on said support boom for movement between an operative position, whereat the shoe is arranged adjacent to the digging chain assembly, and an inoperative position;

a hydraulically actuated cylinder articulately joined to said support boom for extension/retraction along a path extending generally parallel to said support boom;

a linkage mechanism including a pair of links connected to said shoe and to said support boom, said links being connected to each other and to said hydraulic cylinder at a common joinder; and means for automatically locking said shoe in its operative position, said automatic locking mechanism including a lock slidably movable under the influence of said cylinder between opposite ends of said elongated slot and into locking coaction with said lock receiving channel, said elongated slot and said lock receiving channel being aligned relative to each other upon said shoe moving into its operative position whereby allowing said lock to slide into said channel upon extension of said cylinder thereby establishing a locked relationship between said shoe and the support boom and with said lock being readily removable from the locking channel upon retraction of the cylinder thereby causing said shoe to move toward its inoperative position.

5. The crumber mechanism according to claim 4 wherein said linkage mechanism includes a push/pull link connected between said cylinder and said shoe and a guide link connected between said support boom and the cylinder.

6. The crumber mechanism according to claim 4 wherein said shoe includes a pair of side plates which define said elongated slot, and with said support boom including a pair of side plates extending generally parallel to the side plates of said shoe and defining said locking channel.

7. The crumber according to claim 4 wherein said locking channel is adapted to snugly receive the slidable lock between opposed locking surfaces defined by said support boom.

* * * * *

UNITED STATES PATENT AND TRADEMARK OFFICE

CERTIFICATE OF CORRECTION

PATENT NO. : 5,189,817

DATED : March 2, 1993

INVENTOR(S) : Philip W. Schroeder

It is certified that error appears in the above-identified patent and that said Letters Patent is hereby corrected as shown below:

Column 6, Claim 3, Line 5, after "when"
insert --said shoe is--.

Signed and Sealed this

Sixteenth Day of November, 1993

*Attest:*

Bruce Lehman

BRUCE LEHMAN

*Attesting Officer*

*Commissioner of Patents and Trademarks*